US005565087A

United States Patent [19]

Brown et al.

[11] Patent Number: 5,565,087

[45] Date of Patent: Oct. 15, 1996

[54] METHOD FOR PROVIDING A TUBE HAVING COKE FORMATION AND CARBON MONOXIDE INHIBITING PROPERTIES WHEN USED FOR THE THERMAL CRACKING OF HYDROCARBONS

[75] Inventors: Ronald E. Brown; Larry E. Reed; Gil J. Greenwood; Timothy P. Harper; Mark D. Scharre, all of Bartlesville, Okla.

[73] Assignee: Phillips Petroleum Company, Bartlesville, Okla.

[21] Appl. No.: 409,292

[22] Filed: Mar. 23, 1995

[51] Int. Cl.[6] ..... C10G 9/16

[52] U.S. Cl. ..... 208/48 R; 208/48 AA; 208/52 CT; 106/1.12; 106/1.25

[58] Field of Search ..... 208/48 R, 48 AA; 106/1.12, 1.25

[56] References Cited

U.S. PATENT DOCUMENTS

| | | | |
|---|---|---|---|
| 4,410,418 | 10/1983 | Kukes | 208/48 R |
| 4,692,234 | 9/1987 | Porter et al. | 208/48 AA |
| 4,804,487 | 2/1989 | Reed et al. | 208/48 R |
| 5,284,994 | 2/1994 | Brown et al. | 585/648 |
| 5,358,626 | 10/1984 | Gandman et al. | 208/48 R |
| 5,435,904 | 7/1995 | Reed et al. | 208/48 R |

*Primary Examiner*—Helane Myers
*Attorney, Agent, or Firm*—Charles W. Stewart

[57] ABSTRACT

The rate of formation of carbon on the surfaces of thermal cracking tubes and the production of carbon monoxide during thermal cracking of hydrocarbons are inhibited by the use of cracking tubes treated with an antifoulant, including tin compound, silicon compound and sulfur compounds in the presence of a reducing gas such as hydrogen. Additionally, the concentration of carbon monoxide in a pyrolytic cracking process product stream is reduced by the treatment of the thermal cracking tubes of such process with a reducing gas having a concentration of a sulfur compound.

7 Claims, 2 Drawing Sheets

METHOD FOR PROVIDING A TUBE HAVING COKE FORMATION AND CARBON MONOXIDE INHIBITING PROPERTIES WHEN USED FOR THE THERMAL CRACKING OF HYDROCARBONS

The present invention generally relates to processes for the thermal cracking of hydrocarbons and, specifically, to a method for providing a tube of a thermal cracking furnace having coke formation and carbon monoxide production inhibiting properties when used for the thermal cracking of hydrocarbons.

In a process for producing an olefin compound, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace.

Within the furnace, the saturated hydrocarbon is converted into an olefinic compound. For example, an ethane stream introduced into the cracking furnace is converted into ethylene and appreciable amounts of other hydrocarbons. A propane stream introduced into the furnace is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, pentenes, and naphthalene. Olefinic compounds are an important class of industrial chemicals. For example, ethylene is a monomer or comonomer for making polyethylene. Other uses of olefinic compounds are well known to those skilled in the art.

As a result of the thermal cracking of a hydrocarbon, the cracked product stream can also contain appreciable quantities of pyrolytic products other than the olefinic compounds including, for example, carbon monoxide. It is undesirable to have an excessively high concentration of carbon monoxide in a cracked product stream; because, it can cause the olefinic product to be "off-spec" due to such concentration. Thus, it is desirable and important to maintain the concentration of carbon monoxide in a cracked product stream as low as possible.

Another problem encountered in thermal cracking operations is in the formation and laydown of carbon or coke upon the tube and equipment surfaces of a thermal cracking furnace. This buildup of coke on the surfaces of the cracking furnace tubes can result in an excessive pressure drop across such tubes thereby necessitating costly furnace shutdown in order to decoke or to remove the coke buildup. Therefore, any reduction in the rate of coke formation and coke buildup is desirable in that it increases the run length of a cracking furnace between decokings.

It is thus an object of this invention to provide an improved process for cracking saturated hydrocarbons to produce olefinic end-products.

Another object of this invention is to provide a process for reducing the formation of carbon monoxide and coke in a process for cracking saturated hydrocarbons.

A still further object of this invention is to improve the economic efficiency of operating a cracking process for cracking saturated hydrocarbons by providing a method for treating the tubes of a cracking furnace so as to provide treated tubes having coke formation and carbon monoxide production inhibiting properties.

In accordance with one embodiment of the invention, a tube of a thermal cracking furnace is treated with an antifoulant composition so as to provide a treated tube having properties which inhibit the formation of coke when utilized in a thermal cracking operation. The method for treating the thermal cracking tube includes contacting under an atmosphere of a reducing gas, the tube with the antifoulant composition which comprises a compound selected from the group consisting of a tin compound, silicon compound, and combinations thereof.

Another embodiment of the invention includes a method for reducing a concentration of carbon monoxide present in a cracked gas stream produced by passing a hydrocarbon stream through a tube of a thermal cracking furnace. This method includes treating the tubes of the thermal cracking furnace by contacting it with a hydrogen gas containing a sulfur compound thereby providing a treated tube having properties which inhibit the production of carbon monoxide during the thermal cracking of hydrocarbons. The hydrocarbon stream is passed through the treated tubes while maintaining the treated tubes under suitable cracking conditions to thereby produce a cracked gas stream having a reduced concentration of carbon monoxide below the concentration of carbon monoxide that would be present in a cracked gas stream produced by an untreated tube.

Figure 1:
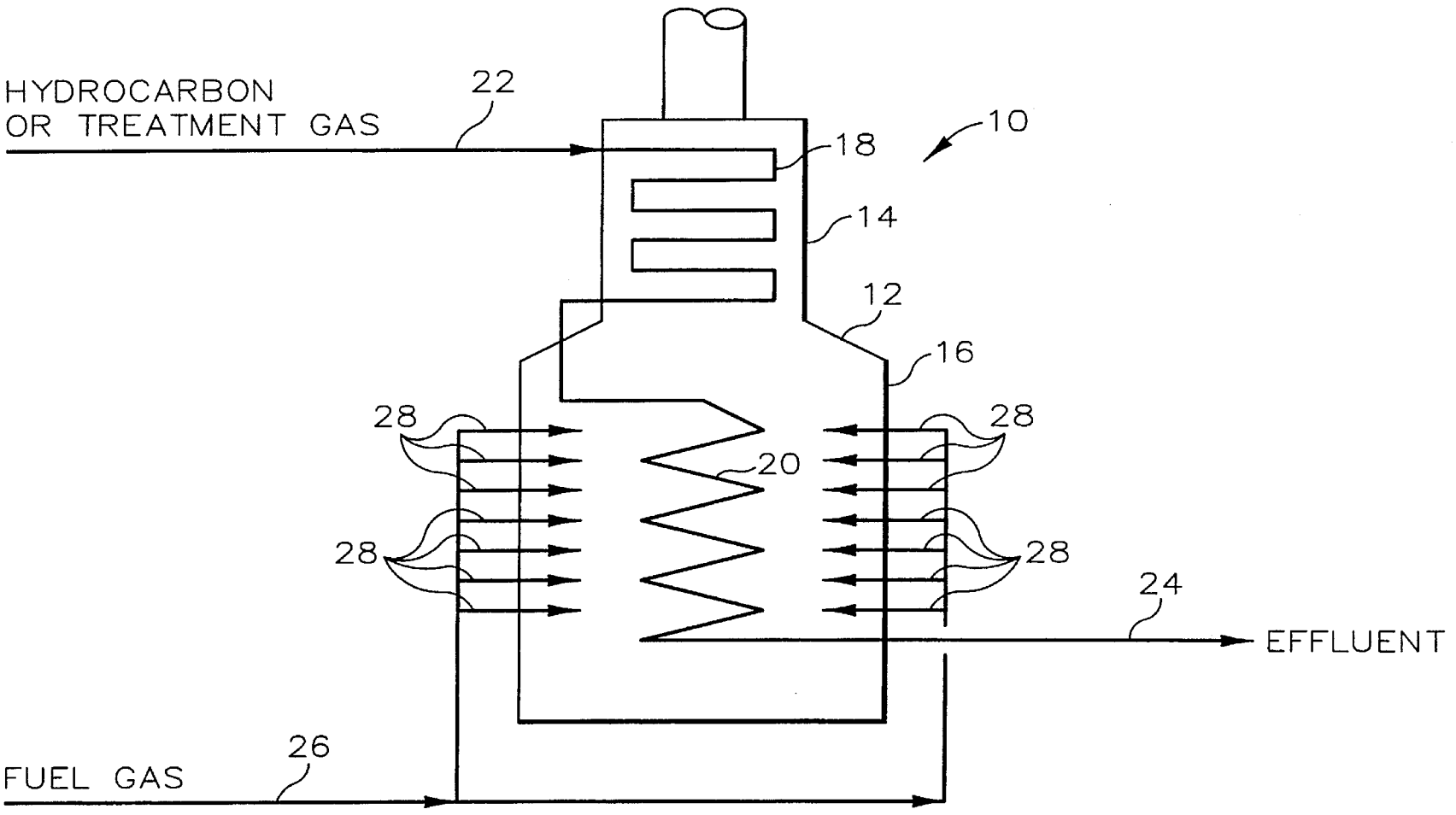
FIG. 1 provides a schematic representation of the cracking furnace section of a pyrolytic cracking process system in which the tubes of such system are treated by the novel methods described herein.

Other objects and advantages of the invention will be apparent from the following detailed description of the invention and the appended claims thereof.

The process of this invention involves the pyrolytic cracking of hydrocarbons to produce desirable hydrocarbon end-products. A hydrocarbon stream is fed or charged to pyrolytic cracking furnace means wherein the hydrocarbon stream is subjected to a severe, high-temperature environment to produce cracked gases. The hydrocarbon stream can comprise any type of hydrocarbon that is suitable for pyrolytic cracking to olefin compounds. Preferably, however, the hydrocarbon stream can comprise paraffin hydrocarbons selected from the group consisting of ethane, propane, butane, pentane, naphtha, and mixtures of any two or more thereof. Naphtha can generally be described as a complex hydrocarbon mixture having a boiling range of from about 180° F. to about 400° F. as determined by the standard testing methods of the American Society of Testing Materials (ASTM).

The cracking furnace means of the inventive method can be any suitable thermal cracking furnace known in the art. The various cracking furnaces are well known to those skilled in the art of cracking technology and the choice of a suitable cracking furnace for use in a cracking process is generally a matter of preference. Such cracking furnaces, however, are equipped with at least one cracking tube to which the hydrocarbon feedstock is charged or fed. The cracking tube provides for and defines a cracking zone contained within the cracking furnace. The cracking furnace is utilized to release the heat energy required to provide for the necessary cracking temperature within the cracking zone in order to induce the cracking reactions therein. Each cracking tube can have any geometry which suitably defines a volume in which cracking reactions can take place and, thus, will have an inside surface. The term "cracking temperature" as used herein is defined as being the temperature within the cracking zone defined by a cracking tube. The outside wall temperature of the cracking tube can, thus, be higher than the cracking temperature and possibly substantially higher due to heat transfer considerations. Typical pressures within the cracking zone will generally be in the range of from about 5 psig to about 25 psig and, preferably from 10 psig to 20 psig.

As an optional feature of the invention, the hydrocarbon feed being charged to pyrolytic cracking furnace means can be intimately mixed with a diluent prior to entering pyrolytic cracking furnace means. This diluent can serve several positive functions, one of which includes providing desirable reaction conditions within pyrolytic cracking furnace means for producing the desired reactant end-products. The diluent does this by providing for a lower partial pressure of hydrocarbon feed fluid thereby enhancing the cracking reactions necessary for obtaining the desired olefin products while reducing the amount of undesirable reaction products such as hydrogen and methane. Also, the lower partial pressure resulting from the mixture of the diluent fluid helps in minimizing the amount of coke deposits that form on the furnace tubes. While any suitable diluent fluid that provides these benefits can be used, the preferred diluent fluid is stream.

The cracking reactions induced by pyrolytic cracking furnace means can take place at any suitable temperature that will provide the necessary cracking to the desirable end-products or the desired feed conversion. The actual cracking temperature utilized will depend upon the composition of the hydrocarbon feed stream and the desired feed conversion. Generally, the cracking temperature can range upwardly to about 2000° F. or greater depending upon the amount of cracking or conversion desired and the molecular weight of the feedstock being cracked. Preferably, however, the cracking temperature will be in the range of from about 1200° F. to about 1900° F. Most preferably, the cracking temperature can be in the range from 1500° F. to 1800° F.

A cracked gas stream or cracked hydrocarbons or cracked hydrocarbon stream from pyrolytic cracking furnace means will generally be a mixture of hydrocarbons in the gaseous phase. This mixture of gaseous hydrocarbons can comprise not only the desirable olefin compounds, such as ethylene, propylene, butylene, and amylene; but, also, the cracked hydrocarbon stream can contain undesirable contaminating components, which include carbon monoxide.

It is generally observed that at the beginning or start of the charging of a feedstock to either a virgin cracking tube or a cracking tube that has freshly been regenerated by decoking, the concentration of undesirable carbon monoxide in the cracked hydrocarbon stream will be higher or reach a maximum concentration peak, which will herein be referred to as peak concentration. Once the carbon monoxide concentration in the cracked hydrocarbon stream reaches its peak or maximum concentration, over time it will gradually decrease in an almost asymptotic fashion to some reasonably uniform concentration. While the asymptotic concentration of carbon monoxide will often be sufficiently low to be within product specifications; often, the peak concentration will exceed specifications when there are no special efforts taken to prevent an excessive peak concentration of carbon monoxide. In untreated tubes, the peak concentration of carbon monoxide can exceed 9.0 weight percent of the cracked hydrocarbon stream. Conventionally treated tubes provide for a peak concentration in the range from about 6 weight percent to about 8.5 weight percent and an asymptotic concentration in the range of from 1 weight percent to 2 weight percent.

The novel cracker tube treatment methods described herein provide for a reduced cumulative production of carbon monoxide in the cracked hydrocarbon stream during the use of such treated cracker tubes, and they provide for a lower peak concentration and asymptotic concentration of carbon monoxide. It has been found that the use of cracker tubes treated in accordance with the novel methods described herein can result in a reduced peak concentration of carbon monoxide in a cracked hydrocarbon stream below that of conventionally treated tubes with the peak concentration being in the range of from about 3 weight percent to about 5 weight percent. The asymptotic concentration of carbon monoxide in a cracked hydrocarbon stream from cracker tubes treated in accordance with the novel methods described herein also can be lower than that of conventionally treated tubes with such asymptotic concentration being less than 1 weight percent. In addition to preventing an off-spec olefin product, another advantage from having a lower carbon monoxide production in the cracking of hydrocarbons is that the hydrocarbons are not converted to carbon monoxide, but they are converted to the more desirable olefin end-products.

A critical aspect of the inventive method includes the treatment or treating of the tubes of a cracking furnace by contacting the surfaces of such tubes with an antifoulant composition while under an atmosphere of a reducing gas and under suitable treatment conditions. It has been discovered that the coke formation inhibiting properties of a cracking tube are improved by treating such cracking tube with the antifoulant composition in a reducing gas atmosphere as opposed to treatment without the presence of a reducing gas. Thus, the use of the reducing gas is an important aspect of the inventive method.

The reducing gas used in the inventive method can be any gas which can suitably be used in combination with the antifoulant composition during treatment so as to provide an enhancement in the ability of the treated tube to inhibit the formation of coke and the production of carbon monoxide during cracking operation. The preferred reducing gas, however, is hydrogen.

The antifoulant composition used to treat the tubes of the cracking furnace in the presence of a reducing gas such as hydrogen can be any suitable compound that provides for a treated tube having the desirable ability to inhibit the rate of coke formation and carbon monoxide production as compared with an untreated tube or a tube treated in accordance with other known methods. Such suitable antifoulant compositions can comprise compounds selected from the group consisting of tin compounds, silicon compounds and mixtures thereof.

Any suitable form of silicon can be utilized as a silicon compound of the antifoulant composition. Elemental silicon, inorganic silicon compounds and organic silicon (organosilicon) compounds as well as mixtures of any two or more thereof are suitable sources of silicon. The term "silicon compound" generally refers to any one of these silicon sources.

Examples of some inorganic silicon compounds that can be used include the halides, nitrides, hydrides, oxides and sulfides of silicon, silicic acids and alkali metal salts thereof. Of the inorganic silicon compounds, those which do not contain halogen are preferred.

Examples of organic silicon compounds that may be used include compounds of the formula

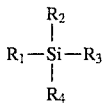

wherein $R_1$, $R_2$, $R_3$, and $R_4$ are selected independently from the group consisting of hydrogen, halogen, hydrocarbyl, and oxyhydrocarbyl and wherein the compound's bonding may be either ionic or covalent. The hydrocarbyl and oxyhydrocarbyl radicals can have from 1 to 20 carbon atoms which may be substituted with halogen, nitrogen, phosphorus, or sulfur. Exemplary hydrocarbyl radicals are alkyl, alkenyl, cycloalkyl, aryl, and combinations thereof, such as alkylaryl or alkylcycloalkyl. Exemplary oxyhydrocarbyl radicals are alkoxide, phenoxide, carboxylate, ketocarboxylate and diketone (dione). Suitable organic silicon compounds include trimethylsilane, tetramethylsilane, tetraethylsilane, triethylchlorosilane, phenyltrimethylsilane, tetraphenylsilane, ethyltrimethoxysilane, propyltriethoxysilane, dodecyltrihexoxysilane, vinyltriethyoxysilane, tetramethoxyorthosilicate, tetraethoxyoxlhosilicate, polydimethylsiloxane, polydiethylsiloxane, polydihexylsiloxane, polycyclohexylsiloxane, polydiphenylsiloxane, polyphenylmethylsiloxane, 3-chloropropyltrimethoxysilane, and 3-aminopropyltriethoxysilane. At present hexamethyldisiloxane is preferred.

Organic silicon compounds are particularly preferred because such compounds are soluble in the feed material and in the diluents which are preferred for preparing pretreatment solutions as will be more fully described hereinafter. Also, organic silicon compounds appear to have less of a tendency towards adverse effects on the cracking process than do inorganic silicon compounds.

Any suitable form of tin can be utilized as the tin compound of the antifoulant composition. Elemental tin, inorganic tin compounds and organic tin (organotin) compounds as well as mixtures of any two or more thereof are suitable sources of tin. The term "tin compound" generally refers to any one of these tin sources.

Examples of some inorganic tin compounds which can be used include tin oxides such as stannous oxide and stannic oxide; tin sulfides such as stannous sulfide and stannic sulfide; tin sulfates such as stannous sulfate and stannic sulfate; stannic acids such as metastannic acid and thiostannic acid; tin halides such as stannous fluoride, stannous chloride, stannous bromide, stannous iodide, stannic fluoride, stannic chloride, stannic bromide and stannic iodide; tin phosphates such as stannic phosphate; tin oxyhalides such as stannous oxychloride and stannic oxychloride; and the like. Of the inorganic tin compounds those which do not contain halogen are preferred as the source of tin.

Examples of some organic tin compounds which can be used include tin carboxylates such as stannous formate, stannous acetate, stannous butyrate, stannous octoate, stannous decanoate, stannous oxalate, stannous benzoate, and starmous cyclohexanecarboxylate; tin thiocarboxylates such as stannous thioacetate and stannous dithioacetate; dihydrocarbyltin bis(hydrocarbyl mercaptoalkanoates) such as dibutyltin bis(isoocylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetramethyltin, tetrabutyltin, tetraoctyltin, tetradodecyltin, and tetraphenyltin; dihydrocarbyltin oxides such as dipropyltin oxide; dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous-p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous, O,O-dipropyl thiophosphate, stannous O,O-dipropyl dithiophosphate and stannic O,O-dipropyl dithiophosphate, dihydrocarbyltin bis(O,O-dihydrocarbyl thiophosphate)s such as dibutyltin bis(O,O-dipropyldithiophosphate); and the like. At present tetrabutyltin is preferred. Again, as with silicon, organic tin compounds are preferred over inorganic compounds.

The tubes treated with the antifoulant composition in the presence of a reducing gas will have properties providing for a significantly greater suppression of either the rate of coke formation or the amount of carbon monoxide production, or both, when used under cracking conditions than tubes treated exclusively with the antifoulant composition but without the presence of a reducing gas. A preferred procedure for pretreating the tubes of the cracking furnace includes charging to the inlet of the cracking furnace tubes a reducing gas such as hydrogen containing therein a concentration of the antifoulant composition. The concentration of antifoulant composition in the reducing gas can be in the range of from about 1 ppmw to about 10,000 ppmw, preferably from about 10 ppmw to about 1000 ppmw and, most preferably, from 20 to 200 ppmw.

Another embodiment of the invention includes treating the tubes of a cracking furnace by contacting such tubes with a reducing gas, such as hydrogen, containing a sulfur compound to thereby provide a treated tube. The sulfur compound used in combination with the reducing gas to treat the cracking furnace tubes can be any suitable sulfur compound that provides for a treated tube having the desirable ability to inhibit the production of carbon monoxide when used in cracking operations.

Suitable sulfur compounds utilized include, for example, compounds selected from the group consisting of sulfide compounds and disulfide compounds. Preferably, the sulfide compounds are alkylsulfides with the alkyl substitution groups having from 1 to 6 carbon atoms, and the disulfide compounds are dialkylsulfides with the alkyl substitution groups having from 1 to 6 carbon atoms. The most preferred alkylsulfide and dialkylsulfide compounds are respectively dimethylsulfide and dimethyl disulfide.

The tubes treated with a reducing gas having a concentration of a sulfur compound will have the ability to inhibit the amount of carbon monoxide produced when used under cracking conditions. Also, both the peak concentration and the asymptotic concentration of carbon monoxide in the cracker effluent stream are reduced below those of a cracked effluent stream from untreated or conventionally treated cracker furnace tubes. Specifically, for the tubes treated with the reducing gas having a concentration of a sulfur compound, the peak concentration of carbon monoxide in the cracker effluent stream from such tube can be in the range of from about 3 weight percent to about 5 weight percent of the total effluent stream. The asymptotic concentration approaches less than 1 weight percent of the total effluent stream.

The tubes treated with the reducing gas containing a sulfur compound will have properties providing for a reduction in the production of carbon monoxide when used under cracking conditions below that of tubes treated with sulfur compounds but not in the presence of a reducing gas. It is preferred to contact the tubes under suitable treatment conditions with the reducing gas having a concentration of a sulfur compound. The reducing gas, which contains the sulfur compound, used to treat the cracker tubes is preferably hydrogen gas. The concentration of the sulfur compound in the hydrogen gas used for treating the cracker tubes can be in the range of from about 1 ppmw to about 10,000 ppmw, preferably, from 10 ppmw to about 1000 ppmw and, most preferably, from 20 to 200 ppmw.

The temperature conditions under which the reducing gas, having the concentration of the antifoulant composition or the sulfur compound, is contacted with the cracking tubes can include a contacting temperature in the range upwardly to about 2000° F. In any event, the contacting temperature must be such that the surfaces of the cracker tubes are properly passivated and include a contacting temperature in the range of from about 300° F. to about 2000° F., preferably, from about 400° F. to about 1800° F. and, most preferably, from 500° F. to 1600° F.

The contacting pressure is not believed to be a critical process condition, but it can be in the range of from about atmospheric to about 500 psig. Preferably, the contacting pressure can be in the range of from about 10 psig to about 300 psig and, most preferably, 20 psig to 150 psig.

The reducing gas stream having a concentration of antifoulant composition or sulfur compound is contacted with or charged to the cracker tubes for a period of time sufficient to provide treated tubes, which when placed in cracking service, will provide for the reduced rate of coke formation or carbon monoxide production, or both, relative to untreated tubes or tubes treated with the antifoulant without the presence of a reducing gas. Such time period for pretreating the cracker tubes is influenced by the specific geometry of the cracking furnace including its tubes; but, generally, the pretreating time period can range upwardly to about 12 hours, and longer if required. But, preferably, the period of time for the pretreating can be in the range of from about 0.1 hours to about 12 hours and, most preferably, from 0.5 hours to 10 hours.

Once the tubes of a cracking furnace are treated in accordance with the procedures described herein, a hydrocarbon feedstock is charged to the inlet of such treated tubes. The tubes are maintained under cracking conditions so as to provide for a cracked product stream exiting the outlet of the treated tubes. The cracked product stream exiting the tubes which have been treated in accordance with the inventive methods has a reduced concentration of carbon monoxide that is lower than the concentration of carbon monoxide in a cracked product stream exiting cracker tubes that have not been treated with an antifoulant composition or a sulfur compound or that have been treated with an antifoulant composition or a sulfur compound but not with the critical utilization of a reducing gas. As earlier described herein, the concentration of carbon monoxide in the cracked product stream from tubes treated in accordance with the novel methods can be less than about 5.0 weight percent. Preferably, the carbon monoxide concentration is less than about 3.0 weight percent and, most preferably, the carbon monoxide concentration is less than 2.0 weight percent.

Another important benefit that results from the treatment of cracker tubes by the inventive method utilizing an antifoulant composition is a reduction in the rate of coke formation in comparison with the coke formation rate with untreated tubes or tubes treated with an antifoulant composition but without the presence of a reducing gas during such treatment. This reduction in the rate of coke formation permits the treated cracker tubes to be used for longer run lengths before decoking is required.

Now referring to FIG. 1, there is illustrated by schematic representation a cracking furnace section 10 of a pyrolytic cracking process system. Cracking furnace section 10 includes pyrolytic cracking means or cracking furnace 12 for providing heat energy required for inducing the cracking of hydrocarbons. Cracking furnace 12 defines both convection zone 14 and radiant zone 16. Respectively within such zones are convection coils as tubes 18 and radiant coils as tubes 20.

A hydrocarbon feedstock is conducted to the inlet of convection tubes 18 by way of conduit 22, which is in fluid flow communication with convection tubes 18. Also, during the treatment of the tubes of cracking furnace 12, the mixture of hydrogen gas and antifoulant composition or sulfur compound can also be conducted to the inlet of convection tubes 18 though conduit 22. The feed passes through the tubes of cracking furnace 12 wherein it is heated to a cracking temperature in order to induce cracking or, in the situation where the tubes are undergoing treatment, to the required treatment temperature. The effluent from cracking furnace 12 passes downstream through conduit 24 where it is further processed. To provide for the heat energy necessary to operate cracking furnace 12, fuel gas is conveyed through conduit 26 to burners 28 of cracking furnace 12 whereby the fuel gas is burned and heat energy is released.

The following examples are provided to further illustrate the present invention.

EXAMPLE 1

This example describes the experimental procedures used to treat a cracking tube and provides the results from such procedures. A comparative run and an inventive run were performed with the results being presented in FIG. 2.

A 12 foot, 1.75 inch I.D. HP-Modified tube was pretreated with sulfur in the form of 500 ppmw dimethylsulfide for a period of three hours. Dimethylsulfide (DMS) was introduced with 26.4 lb/hr steam and 18.3 lb/hr nitrogen at 400° F. and 12 psig several feet upstream of the electric furnace which enclosed the reactor tube. The average temperature in the reactor tube was 1450° F. during pretreatment. Ethane was then charged to the experimental unit at a rate of 25.3 lb/hr, and steam was charged at a rate of 7.6 lb/hr while continuing to inject DMS at a concentration of 500 ppmw. Ethane conversion to ethylene was held constant at 67%. DMS injection was continued at 500 ppm for 9 hours into cracking, then was reduced to 125 ppm for the remainder of the run. Carbon monoxide production in the cracked gas, which is an indirect measure of the degree of coking, was monitored throughout the run.

In a subsequent run, the same tube was pretreated with a DMS/hydrogen mixture at a 1:1 (mole) ratio. The DMS concentration during pretreatment was 500 ppmw and all other conditions were the same during the pretreatment and during the cracking run. The carbon monoxide production in the cracked gas was monitored.

Figure 2:
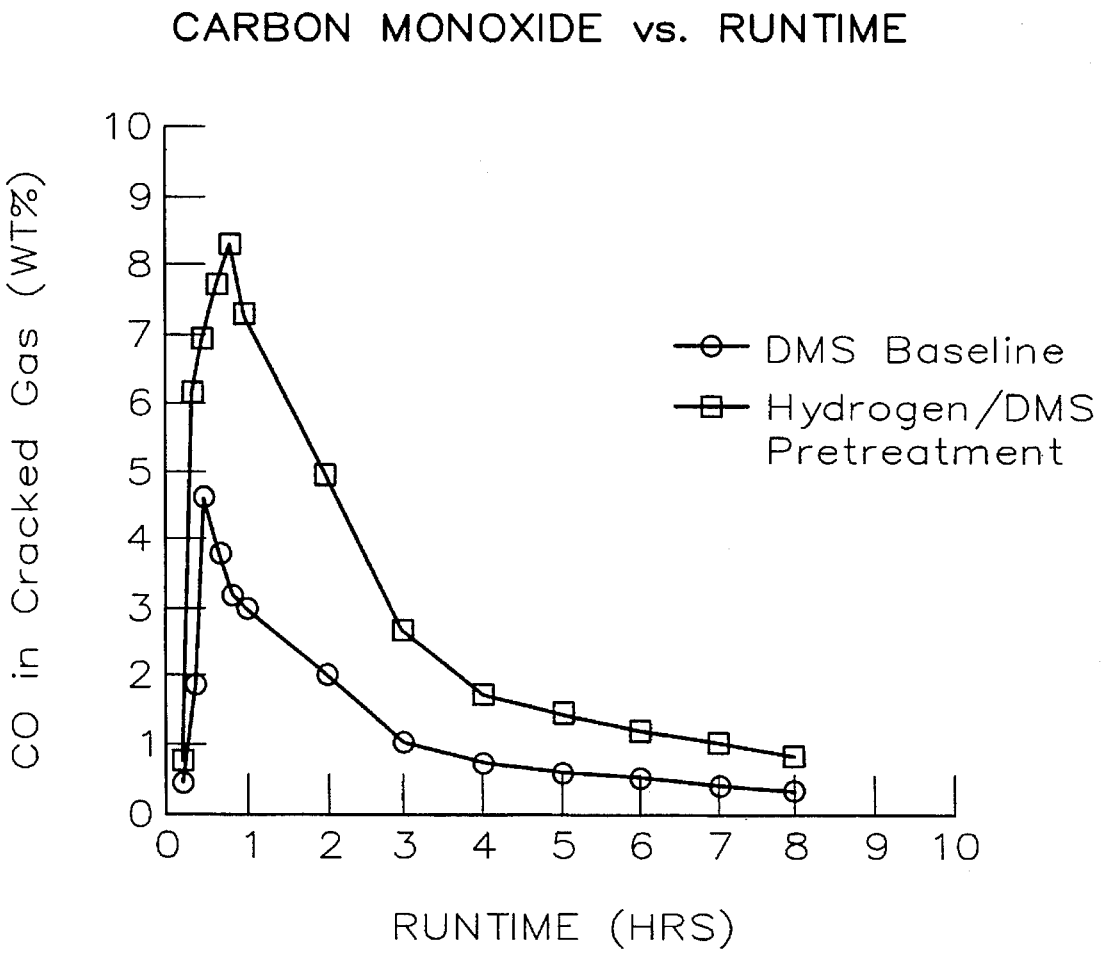
FIG. 2 is a plot of the weight percent of carbon .monoxide in a cracked gas stream versus the time of on-line cracker operation for tubes treated in accordance with an inventive method described herein and for conventionally treated tubes.

The carbon monoxide concentrations in the cracked gas for both of the runs are shown in FIG. 2. Carbon monoxide concentration showed a peak of 8.3 wt. % for the DMS only run while a peak of only 4.5 wt. % was obtained for the DMS/hydrogen run. The carbon monoxide concentration in the cracked gas remained higher in the DMS baseline run for several hours until the coke formed on the tube surface minimized reactions to carbon monoxide. These results clearly demonstrate the advantage of utilizing DMS in a reducing environment.

EXAMPLE 2

This example describes the experimental procedure used to obtain data pertaining to the addition of hydrogen (reducing atmosphere) with an antifoulant during pretreatment injection onto a cracking coil.

The experimental apparatus included a 14' long, 8 pass coil made of ¼" O.D. Incoloy 800 tubing which was heated to the desired temperature in an electric tube furnace. In one run, 50 ppmm tetrabutyl tin (TBT) was injected with steam (37.5 mol/hr) and nitrogen for a period of thirty minutes at an isothermal temperature of 1300° F. in the furnace. The injection was then discontinued and ethane was charged to the reactor at a rate of 745.5 g/hr. Steam was charged with the ethane to the reactor at a rate of 223.5 g/hr. Carbon monoxide in the cracked gas and pressure drop across the reactor coil were monitored continuously throughout the run of eighteen minutes. Coke production in the cracking coils was then measured by analyzing the carbon dioxide and carbon monoxide produced when burning out the coil with a steam/air mixture. In a subsequent run, 50 ppmm tetrabutyl tin was injected with 1.7 standard liters per minute hydrogen at identical conditions as the previous run. This injection was then stopped and ethane was charged to the reactor at identical conditions as the previous run. Again, carbon monoxide production in the cracked gas was monitored and coking rate in the furnace determined for this run which also lasted eighteen minutes. The coking rate as measured by the carbon dioxide produced on burning out of the reactor coil was 585 g/hr, which was substantially less than the 1403 g/hr measured for the run that injected TBT only. The carbon monoxide produced in the cracked gas during the runs was also significantly less for the run that injected the TBT/hydrogen mixture as compared to the TBT only run. The results are shown in Table I for both runs.

These data show that adding the tetrabutyl tin compound in a reducing environment will significantly enhance the reduction of the coking rate and the production of carbon monoxide in the cracked gas.

TABLE I

| | CO in Cracked Gas (Wt. %) | |
|---|---|---|
| Time (min.) | TBT Only | TBT/Hydrogen |
| 6 | 0.024 | 0 |
| 9 | 0.09 | 0.076 |
| 12 | 1.232 | 0.514 |
| 15 | 2.35 | 2.4 |

While this invention has been described in terms of the presently preferred embodiment, reasonable variations and modifications are possible by those skilled in the art. Such variations and modifications are within the scope of the described invention and the appended claims.

That which is claimed is:

1. A method for treating a tube of a thermal cracking furnace with an antifoulant composition prior to service under thermal cracking conditions so as to provide a treated tube having coke formation inhibiting properties under thermal cracking conditions, said method comprising:

contacting under an atmosphere of a reducing gas said tube with said antifoulant composition comprising a compound selected from the group consisting of a tin compound, a silicon compound and combinations thereof.

2. A method as recited in claim 1 wherein said reducing gas comprises hydrogen.

3. A method as recited in claim 1 wherein said antifoulant composition is said tin compound.

4. A method as recited in claim 1 wherein said antifoulant composition is tetrabutyl tin.

5. A method as recited in claim 1 wherein the contacting step is conducted at a temperature in the range of from about 1000° F. to about 1300° F.

6. A method as recited in claim 1 wherein said antifoulant composition consists essentially of said tin compound.

7. A method as-recited in claim 1 wherein the concentration of such antifoulant composition in said atmosphere of said reducing gas is in the range of from about 1 ppmw to about 10,000 ppmw.

* * * * *